US008079488B2

(12) United States Patent
Darflinger

(10) Patent No.: US 8,079,488 B2
(45) Date of Patent: Dec. 20, 2011

(54) LID HAVING A UTENSIL

(76) Inventor: David I. Darflinger, Valdosta, GA (US)

( * ) Notice: Subject to any disclaimer, the term of this patent is extended or adjusted under 35 U.S.C. 154(b) by 793 days.

(21) Appl. No.: 12/116,270

(22) Filed: May 7, 2008

(65) Prior Publication Data

US 2009/0277902 A1 Nov. 12, 2009

(51) Int. Cl.
*B65D 41/56* (2006.01)

(52) U.S. Cl. ..... 220/212; 220/694; 215/228; 215/231; 215/391; 206/541

(58) Field of Classification Search ..... 220/212, 220/735, 694; 215/231, 390, 391, 228; 229/401; 30/326, 327, 328, 147; 206/223, 541, 229, 206/553; 248/690, 691, 340, 341, 573
See application file for complete search history.

(56) References Cited

U.S. PATENT DOCUMENTS 1,174,628 A * 3/1916 Sidway ..... 141/112
1,324,682 A * 12/1919 McIntyre ..... 141/380
2,106,313 A * 1/1938 Amrine ..... 401/128
2,149,698 A * 3/1939 Humphrey ..... 141/112
2,175,735 A * 10/1939 Banks ..... 401/119
2,231,197 A * 2/1941 Scioscia ..... 401/128
3,226,825 A * 1/1966 Molinaro ..... 30/327
5,586,676 A * 12/1996 Lynd ..... 220/212
6,003,710 A 12/1999 Huang
6,371,324 B1 4/2002 Torniainen et al.
6,604,646 B2 8/2003 Torniainen et al.
2007/0102061 A1 * 5/2007 Tsao ..... 141/380

* cited by examiner

*Primary Examiner* — Mickey Yu
*Assistant Examiner* — Jenine Pagan
(74) *Attorney, Agent, or Firm* — Dale J. Ream

(57) ABSTRACT

A lid for use with a jar having an opening includes a closure member configured to cover the jar opening when the closure member is fastened to the jar. The lid includes an attachment member coupled to the closure member to selectively fasten the closure member to the jar. A catch is coupled to the closure member that extends toward the jar when the closure member is fastened to the jar. The lid includes a utensil having a use end and an opposed attachment end. A hook extends from the utensil attachment end so as to rotatably couple the utensil to the catch, each hook being removable from the catch only when the utensil is generally parallel to the closure member. The utensil has a length that prevents the utensil from being generally parallel to the closure member when the closure member is fastened to the jar.

4 Claims, 5 Drawing Sheets

LID HAVING A UTENSIL

BACKGROUND OF THE INVENTION

This invention relates generally to utensils and, more particularly, to a lid having a utensil coupled thereto. More particularly, this invention is for a utensil that is removably attached to the underside of a jar lid that may be removed and used to remove the contents from the jar. The utensil may then again be coupled to the lid and stored inside the container itself when the lid is fastened to the container.

Many food items are contained within jars or similar containers that must be removed using a utensil prior to consumption. For example, mayonnaise, pickles, olives, and the like are common examples of food accessory or condiment items that may need to be removed from their storage container using a utensil before consumption. Traditionally, a special utensil stored in another location must be obtained in order to withdraw the contents of the container. That utensil, then, must be cleaned and returned to a storage location until it is needed again.

Various devices have been proposed in the art for maintaining a utensil in proximity to a jar or container with which it is associated. Although assumably effective for their intended purposes, the existing devices do not provide a utensil that extends from an underside of the lid and into the container's contents, but that is removable when desired.

Therefore, it would be desirable to have a lid with a utensil that extends into the container itself in a storage configuration. Further, it would be desirable to have a lid with a utensil that is removable when desired but that is not subject to the utensil becoming inadvertently dislodged into the container's contents.

SUMMARY OF THE INVENTION

A lid for use with a jar having an opening includes a closure member configured to cover the jar opening when the closure member is fastened to the jar. The lid includes an attachment member coupled to the closure member to selectively fasten the closure member to the jar. A catch is coupled to the closure member that extends toward the jar when the closure member is fastened to the jar. The lid includes a utensil having a use end and an opposed attachment end. A hook extends from the utensil attachment end so as to rotatably couple the utensil to the catch, each hook being removable from the catch only when the utensil is generally parallel to the closure member. The utensil has a length that prevents the utensil from being generally parallel to the closure member when the closure member is fastened to the jar.

Therefore, a general object of this invention is to provide a lid with a utensil for use with a jar that has an opening.

Another object of this invention is to provide a lid with a utensil, as aforesaid, in which the utensil extends into the jar when the utensil is coupled to the lid and when the lid is fastened to the jar.

Still another object of this invention is to provide a lid with a utensil, as aforesaid, in which the utensil is removable from the lid when it is rotated generally parallel to the lid.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A lid for use with a jar having an opening will now be described in detail with reference to FIG. 1 through FIG. 5*b* of the accompanying drawings. More particularly, the lid 100 includes a closure member 110 and a utensil 130. "Jar" is used herein to denote any food or beverage container having an open end that can be closed by a lid for storage.

Figure 1:
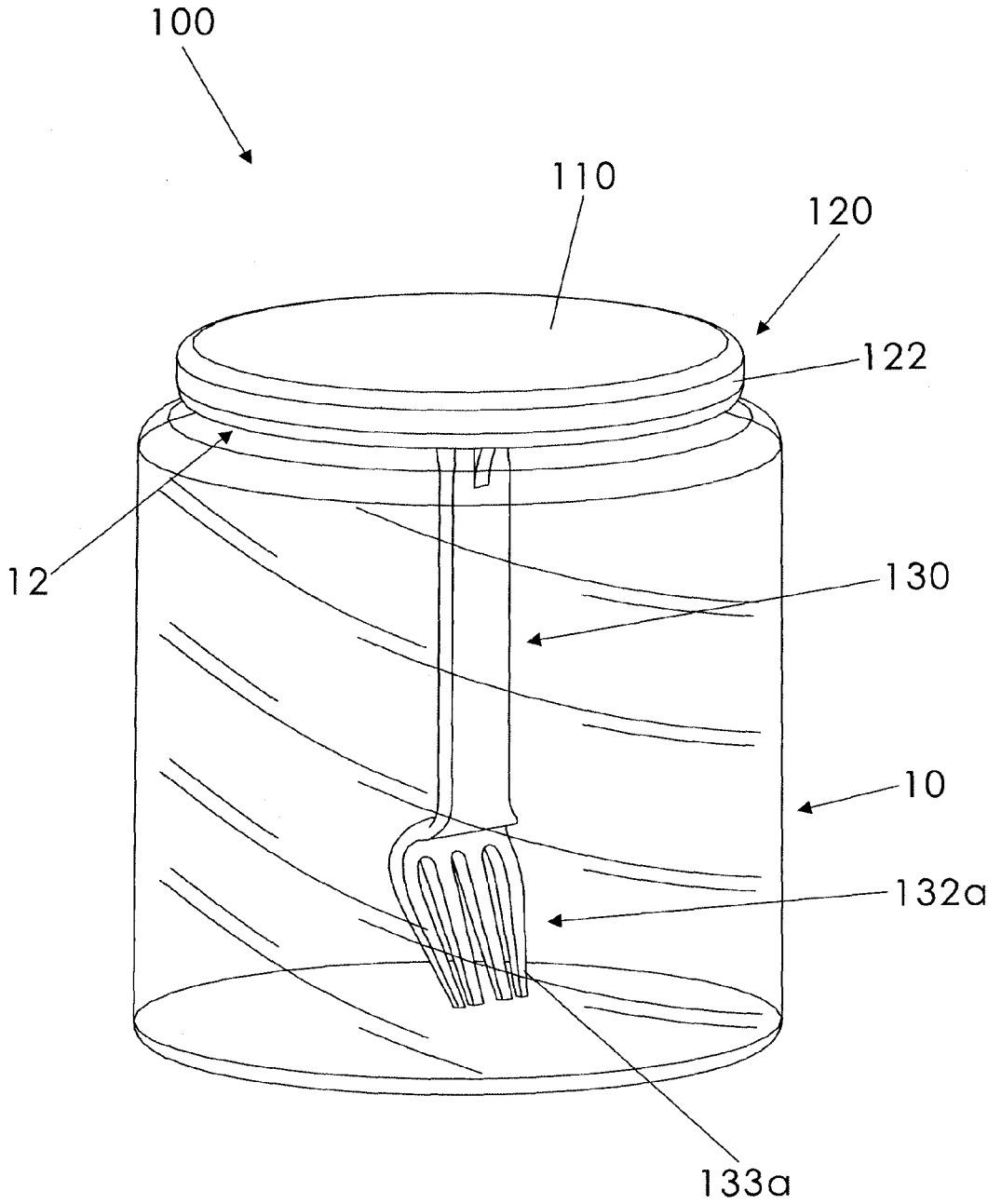
FIG. 1 is a perspective view of a lid with a utensil for use with a jar having an opening according to a preferred embodiment of the present invention.
Figure 5A:
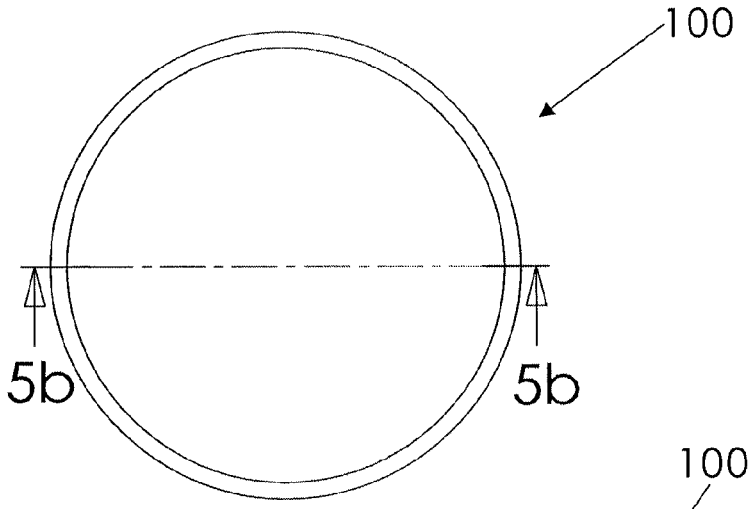
FIG. 5*a* is a top view of a lid with utensil as in FIG. 1.
Figure 5B:
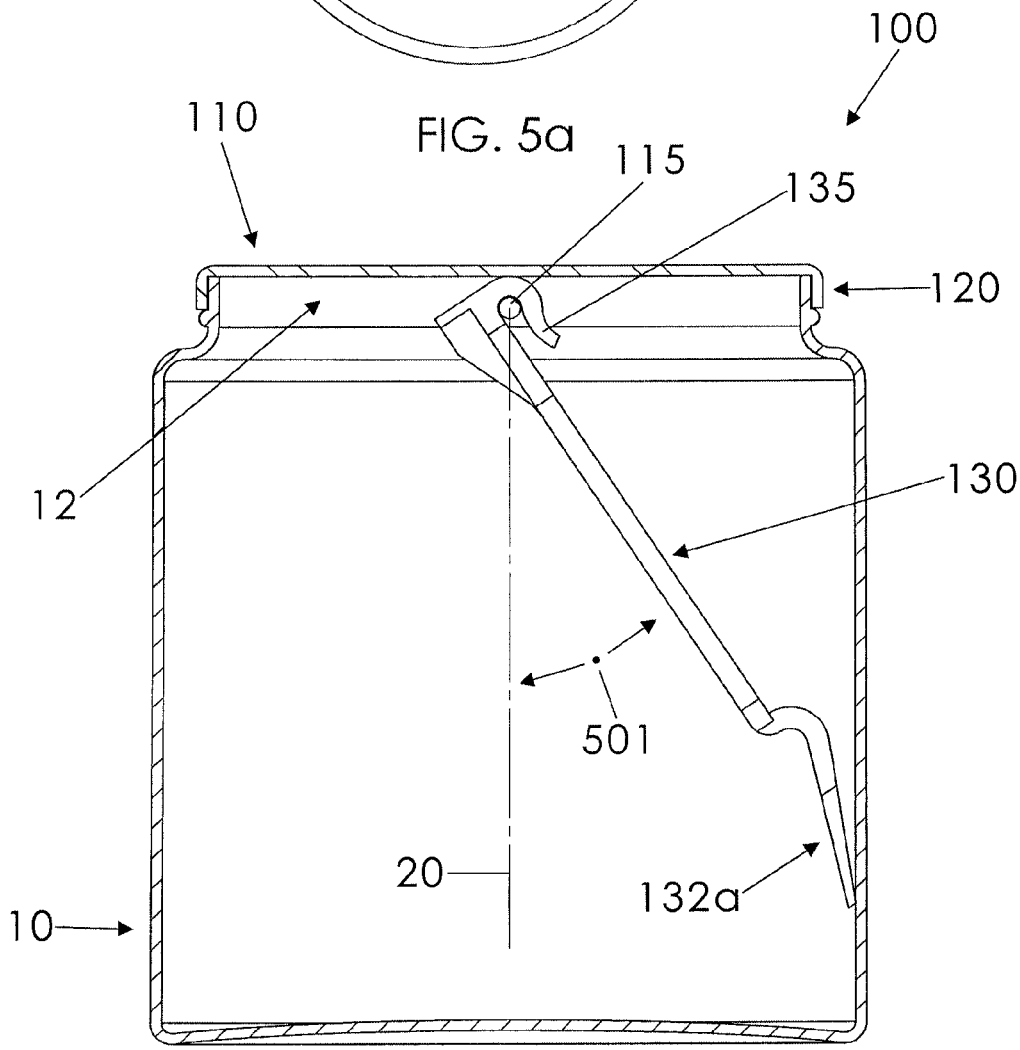
FIG. 5*b* is a sectional view taken along line 5*b*-5*b* of FIG. 5*a*.

As shown in FIGS. 1 and 5*b*, the closure member 110 is configured to cover an opening 12 of a jar 10 when the closure member 110 is fastened to the jar 10. An attachment member 120 is coupled to the closure member 110 to selectively fasten the closure member 110 to the jar 10. The attachment member 120 may include a lip 122 extending from the closure member 110 (as shown throughout the figures), or any other fastener may be used (e.g., a clasp, etc.). If a lip 122 is included, the lip 122 may include thread elements and/or other fastening features. The fastening of a closure member to a jar using various elements and structures is well known in the art, and it should be understood that the current invention may be practiced with any appropriate attachment member.

Figure 3A:
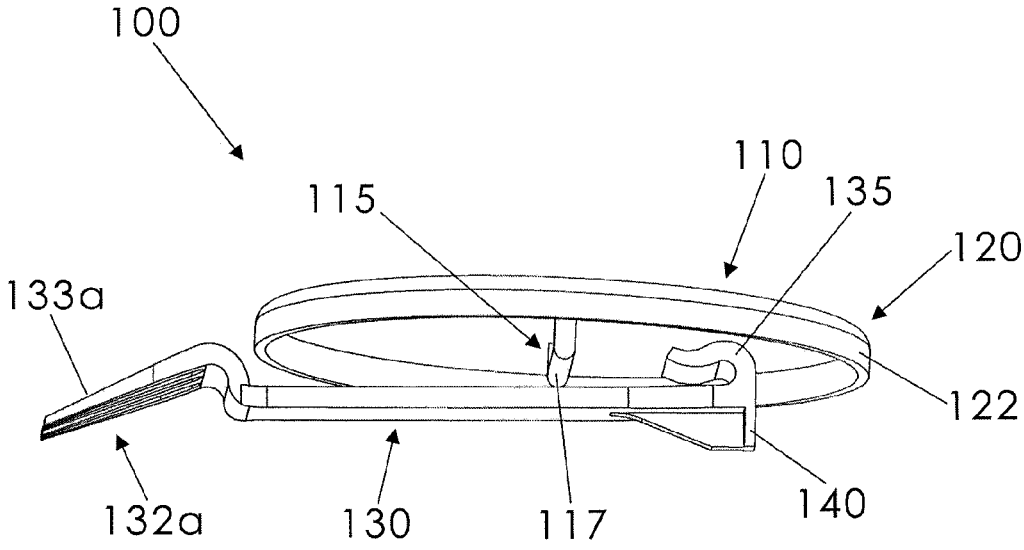
FIG. 3*a* is a perspective view of a lid with a utensil as in FIG. 2*a* with the utensil separated from the lid.
Figure 3B:
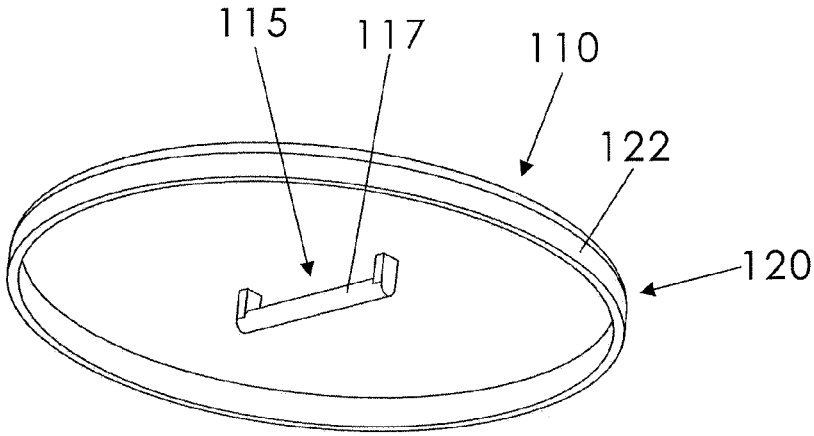
FIG. 3*b* is another perspective view of the lid as in FIG. 3*a* with the utensil completely removed.
Figure 4A:
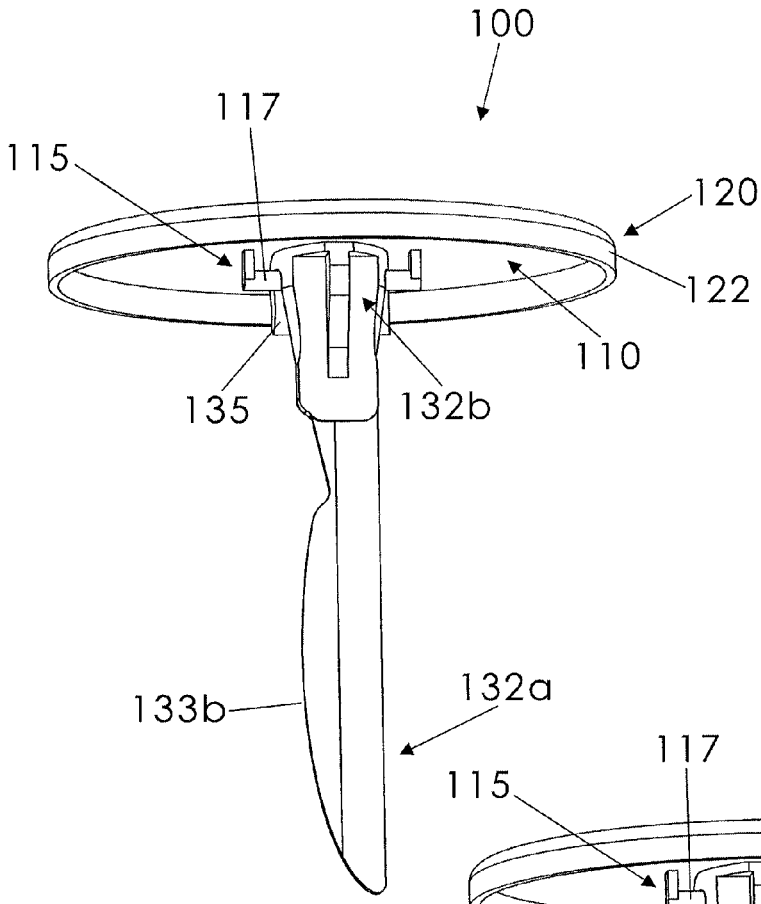
FIG. 4*a* is a perspective view of a lid with a utensil with another type of utensil.
Figure 4B:
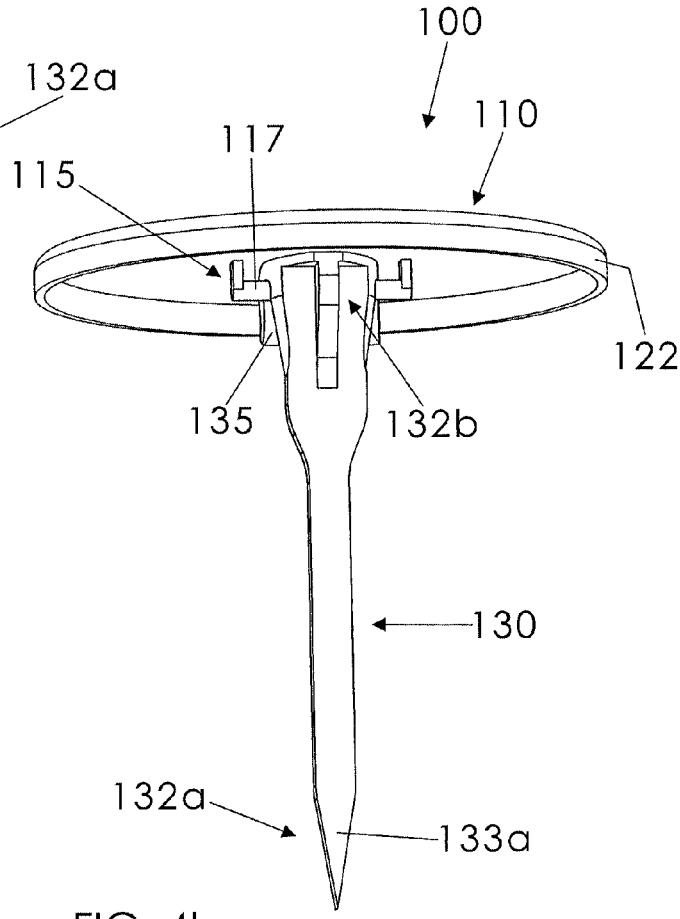
FIG. 4*b* is a perspective view of a lid with a utensil with still another type of utensil.

Either a catch 115 or a hook 135 is coupled to the closure member 110 and extends toward the jar 10 when the closure member 110 is fastened to the jar 10. For example, FIG. 3*b* shows a catch 115 that includes a generally cylindrical bar 117.

Figure 2A:
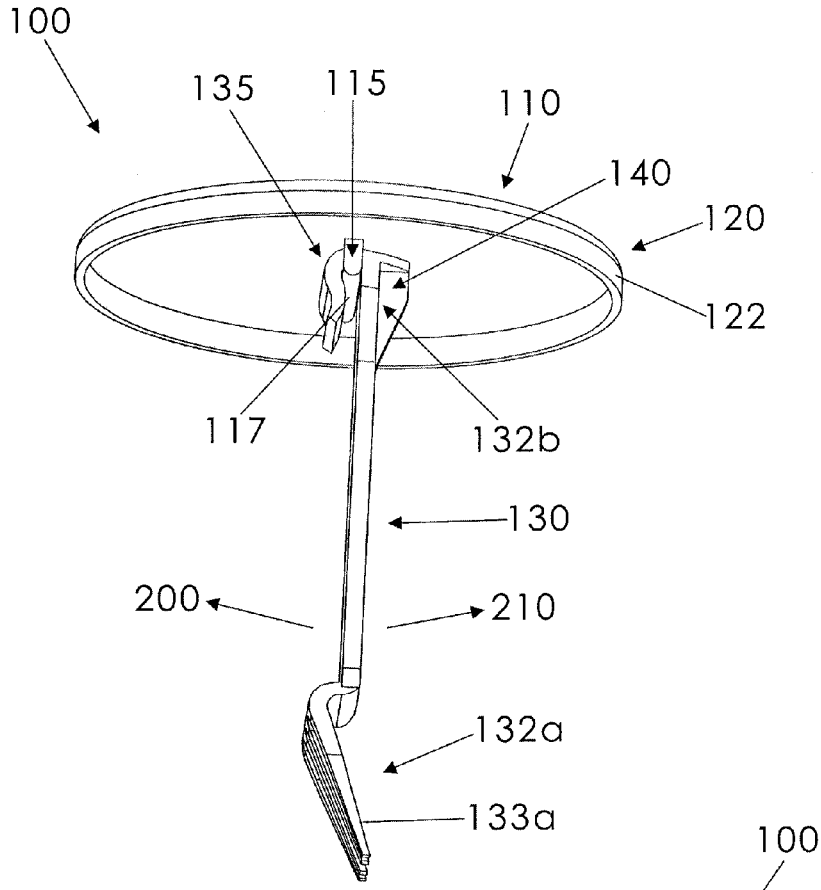
FIG. 2*a* is a perspective view of a lid with a utensil as in FIG. 1 removed from the jar with the utensil in an extended configuration.
Figure 2B:
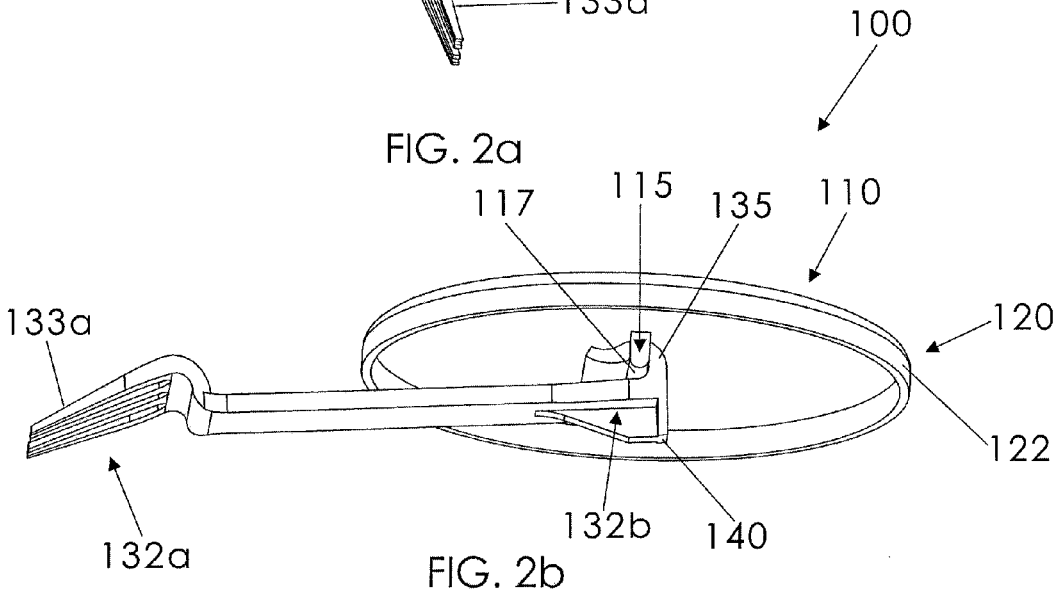
FIG. 2*b* is a perspective view of a lid with a utensil as in FIG. 2*a* with the utensil in a rotated configuration.

The utensil 130 has a use end 132*a* and an opposed attachment end 132*b*, as shown in FIGS. 2*a* and 2*b*. The use end 132*a* may include, for example, one or more tine 133*a* (FIGS. 1-3*a* and 4*b*), a cutting edge 133*b* (FIG. 4*a*), and/or a spoon bowl (not shown). If the closure member 110 includes the catch 115 (FIGS. 2*a* through 4*b*), the attachment end 132*b* includes the hook 135 to rotatably couple the utensil 130 to the closure member 110 by interacting with the catch 115 (e.g., the cylindrical bar 117). Similarly, if the closure member 110 includes the hook 135, the attachment end 132*b* includes the catch 115 to rotatably couple the utensil 130 to the closure member 110 by interacting with the hook 135.

As shown in FIGS. 1 and 5*b*, the utensil 130 may have a length that limits rotation of the utensil 130 relative to a vertical reference 20 (i.e., a vertical line) to a first angle 501 that is less than ninety degrees when the closure member 110 is fastened to the jar 10. The hook 135 may be separable from the catch 115 only when the utensil 130 is rotated relative to the vertical reference 20 to an angle greater than the first angle 501.

In one embodiment, as shown in FIGS. 2*a* through 3*a*, the hook 135 is configured so that the hook 135 is removable from the catch 115 (e.g., the cylindrical bar 117) only when the utensil 130 is generally parallel to the closure member 110. In this configuration, the hook 135 may extend at least 180 degrees around the catch 115 when the hook is coupled to the catch 115 (FIGS. 2*a* and 2*b*). If the hook 135 extends more than 180 degrees around the catch 115, the hook 135 may preferably be constructed of resilient material, and removal of the hook 135 from the catch 115 (and reattachment of the hook 135 to the catch 115) may require deformation of the hook 135.

A stop 140 may extend from the utensil attachment end 132*b* to limit rotation of the utensil 130 relative to the closure member 110 (and relative to the catch 115). For example, as shown in FIG. 2*a*, the hook 135 may extend to one side of the utensil attachment end 132*b*, and the stop 140 may extend to an opposed side of the utensil attachment end 132*b*. As such, the utensil 130 in FIG. 2*a* may rotate in direction 200 but not in direction 210, which results in the hook 135 being separable from the catch 115 only when the utensil 130 is moved in direction 200. The width of the hook 135 and tolerances between the hook 135 and the catch 115 may also be adjusted to restrict movement of the utensil 130 relative to the closure member 110.

In use, contents may be placed in the jar 10 in a traditional manner, and the attachment member 120 couples the closure member 110 to the jar 10 (FIG. 1). To access the contents of the jar 10, the closure member 110 is separated from the jar 10 (FIG. 2*a*), the utensil 130 is rotated relative to the closure member 110 until the hook 135 and the catch 115 may separate (FIG. 2*b*), and then the hook 135 is separated from the catch 115 (FIG. 3*a*). The utensil 130 may be used in a traditional manner once separated from the closure member 110 as described. Once access to the contents of the jar 10 is no longer desired, the utensil 130 may be placed adjacent the closure member 110 (FIG. 3*a*), the hook 135 may be coupled to the catch 115 (FIG. 2*b*), the utensil 130 may be rotated away from the closure member 110 (FIG. 2*a*), and the attachment member 120 may couple the closure member 110 to the jar 10 (FIG. 1).

It is understood that while certain forms of this invention have been illustrated and described, it is not limited thereto except insofar as such limitations are included in the following claims and allowable functional equivalents thereof.

The invention claimed is:

1. A lid for use with a jar having an opening and defining an interior area, said lid comprising:

a closure member configured to cover said jar opening when said closure member is fastened to said jar, said closure member having a top surface defining a completely planar configuration and an opposed bottom surface defining a completely planar configuration;

an attachment member coupled to said closure member to selectively fasten said closure member to said jar;

a catch coupled to said bottom surface of said closure member and extending toward the interior area of said jar when said closure member is fastened to said jar;

a utensil having a use end and an opposed attachment end;

a hook extending from said utensil attachment end configured to rotatably couple said utensil to said catch;

said hook extends to one side of said utensil attachment end; and a stop extends to an opposed side of said utensil attachment end to limit rotation of said utensil relative to said catch, whereby said utensil is only generally parallel to said closure member at one position when coupled to said catch wherein:

said closure member top and bottom surfaces have a unitary construction and having a configuration that is completely planar;

said catch includes a generally cylindrical bar;

said hook is rotatably coupled to said cylindrical bar; and said hook is removable from said cylindrical bar only when said utensil is generally parallel to said closure member.

2. The lid of claim 1, wherein said utensil has a length that prevents said utensil from being generally parallel to said closure member when said closure member is fastened to said jar.

3. The lid of claim 2, wherein said use end of said utensil includes at least one of a tine, a spoon bowl, and a cutting edge.

4. The lid of claim 1, wherein said hook extends at least 180 degrees around said catch when said hook is coupled to said catch.

* * * * *